US005525956A

United States Patent [19]

Hashizume et al.

[11] Patent Number: 5,525,956

[45] Date of Patent: Jun. 11, 1996

[54] ELECTRICAL TERMINAL CONSTRUCTION FOR AN ELECTRONIC COMPONENT

[75] Inventors: Shouichi Hashizume, Yatsuo-machi; Masanori Urayama, Osawano-machi, both of Japan

[73] Assignee: Hokuriku Electric Industry Co., Ltd., Kami-Niikawagun, Japan

[21] Appl. No.: 220,106

[22] Filed: Mar. 30, 1994

[30] Foreign Application Priority Data

| | | | |
|---|---|---|---|
| Mar. 30, 1993 | [JP] | Japan | 5-020864 U |
| Nov. 22, 1993 | [JP] | Japan | 5-316084 |
| Mar. 29, 1994 | [JP] | Japan | 6-059213 |

[51] Int. Cl.[6] ..... H01C 1/14; H01C 10/32

[52] U.S. Cl. ..... 338/322; 338/162; 338/167; 338/171; 338/326; 338/330

[58] Field of Search ..... 338/162, 167, 338/171, 131, 132, 322, 326, 329, 330, 87

[56] References Cited

U.S. PATENT DOCUMENTS

| | | | |
|---|---|---|---|
| 3,671,914 | 6/1972 | Wormser | 338/131 |
| 3,970,986 | 7/1976 | Seyler et al. | 338/171 |
| 4,845,839 | 7/1989 | Brown | 338/162 X |

*Primary Examiner*—Teresa J. Walber
*Assistant Examiner*—Karl Easthom
*Attorney, Agent, or Firm*—Pearne, Gordon, McCoy & Granger

[57] ABSTRACT

An electrical component has a terminal construction allowing it to be electrically and mechanically connected to an electrode. A terminal made of a metal material is mounted on an insulating substrate which has front and rear surfaces and is mounted on the front surface thereof with an electrode. The terminal includes a clamp section for clamping the substrate through front and rear surfaces thereof. The clamp section includes a first contact element contacted with the electrode and a second contact element contacted with the rear surface of the substrate. The first contact element is adhesively bonded to the electrode. Electrical connection between the first contact element and the electrode is carried out by direct contact therebetween. The second contact element of the clamp section is adhesively bonded to the rear surface of the substrate.

20 Claims, 6 Drawing Sheets

ELECTRICAL TERMINAL CONSTRUCTION FOR AN ELECTRONIC COMPONENT

BACKGROUND OF THE INVENTION

The present invention relates to an electronic component such as a variable resistor used for an electronic appliance, and more particularly to a terminal mounting structure for an electronic component.

A terminal of a certain electronic component such as a variable resistor or the like is made of a metal material and includes a clamp section for clamping a substrate through front and rear surfaces of the substrate and a leg section formed so as to be integral with the clamp section. The electronic component of such type is so constructed that an electrode arranged on the substrate and the clamp section of the terminal are bonded to each other by soldering, resulting in the electrode and terminal being electrically and mechanically connected to each other. Thus, after the soldering, it is required to remove flux adhered to the substrate by washing with freon.

Recently, it has been highly desired to restrict use of freon in order to avoid environmental pollution. Nevertheless, it is necessarily required to remove the flux after the soldering, however, a washing agent exhibiting a washing performance substantially equal to freon has not been developed. Thus, in manufacturing of the electronic component, it is highly desired to minimize a soldering operation.

SUMMARY OF THE INVENTION

The present invention has been made in view of the foregoing disadvantage of the prior art.

Accordingly, it is an object of the present invention to provide an electronic component including a connection structure which is capable of permitting a terminal to be electrically and mechanically connected to an electrode arranged on a substrate while eliminating soldering.

It is another object of the present invention to provide an electronic component which is capable of effectively ensuring electrical connection between a terminal and an electrode without soldering.

It is a further object of the present invention to provide an electronic component which is capable of permitting a terminal and an electrode to be firmly joined to each other by means of an adhesive material.

It is still another object of the present invention to provide an electronic component which is capable of keeping positive electrical contact between a terminal and an electrode irrespective of application of undue force to the terminal.

It is a still further object of the present invention to provide an electronic component which is capable of ensuring satisfactory contact between a terminal and an electrode.

In accordance with the present invention, an electronic component is provided. The electronic component includes an insulating substrate having front and rear surfaces, an electronic element arranged on the front surface of the insulating substrate, electrodes arranged on the front surface of the insulating substrate and electrically connected to the electronic element, and a terminal made of a metal material and contacted with one of the electrodes. The terminal includes a clamp section for clamping the substrate through the front and rear surfaces of the substrate. The clamp section includes a member contacted with the one electrode.

The member of the clamp section is bonded to the one electrode by means of a first adhesive material.

In a preferred embodiment of the present invention, electrical connection between the first contact element of the clamp section and the electrode may be carried out by direct contact therebetween. Alternatively, the electrical connection may be carried out using a conductive adhesive material. The first contact element and electrode are bonded to each other by means of the adhesive material, resulting in direct contact therebetween being kept and the clamp section being fixed to the substrate.

In a preferred embodiment of the present invention, the second contact element of the clamp section is adhesively bonded to the rear surface of the substrate, so that when undue force is applied to the terminal, it is prevented from being applied to a contact region between the first contact element of the clamp section and the electrode.

In a preferred embodiment of the present invention, the terminal includes a leg section formed with an external force absorber. The external force absorber is constructed so as to be deformed when external force is applied to the leg section, to thereby prevent the second contact element of the clamp section from being separated from the rear surface of the substrate.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, an electronic component according to the present invention will be described hereinafter with reference to the accompanying drawings.

Figure 1A:
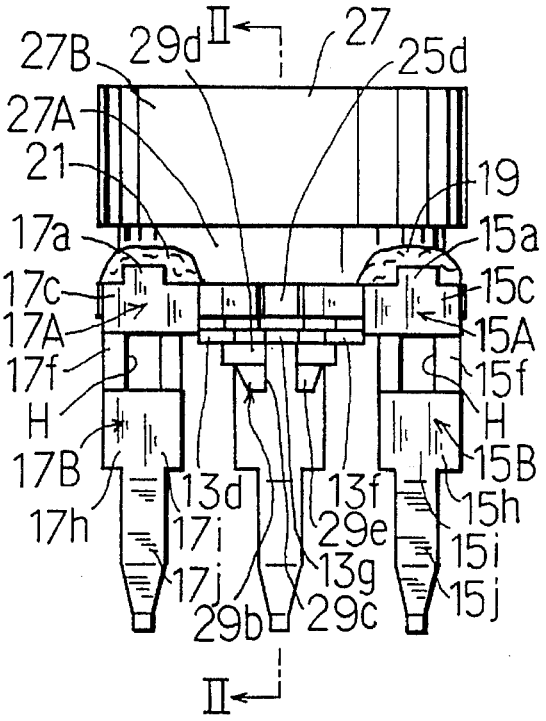
FIG. 1A is a front elevation view showing an embodiment of an electronic component according to the present invention, which is embodied in the form of a variable resistor.
Figure 1B:
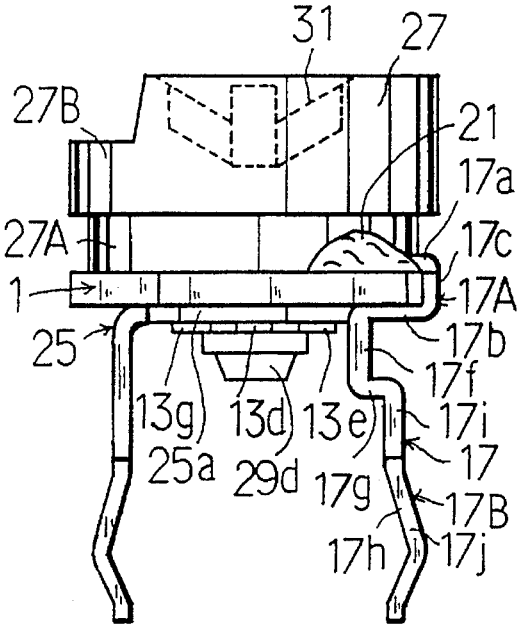
FIG. 1B is a side elevation view of the electronic component shown in FIG. 1A.
Figure 1C:
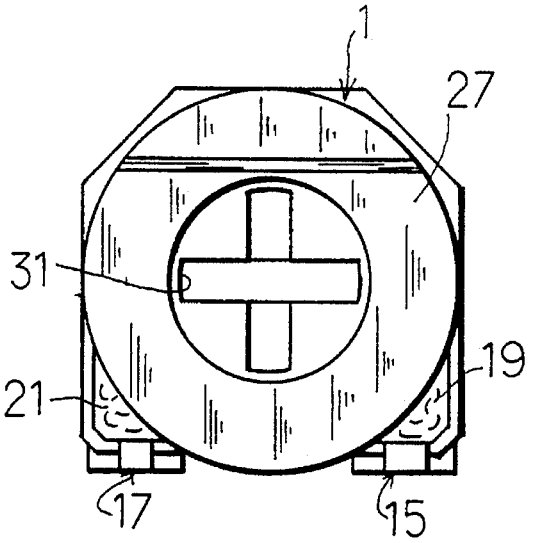
FIG. 1C is a plan view of the electronic component shown in FIG. 1A.
Figure 1D:
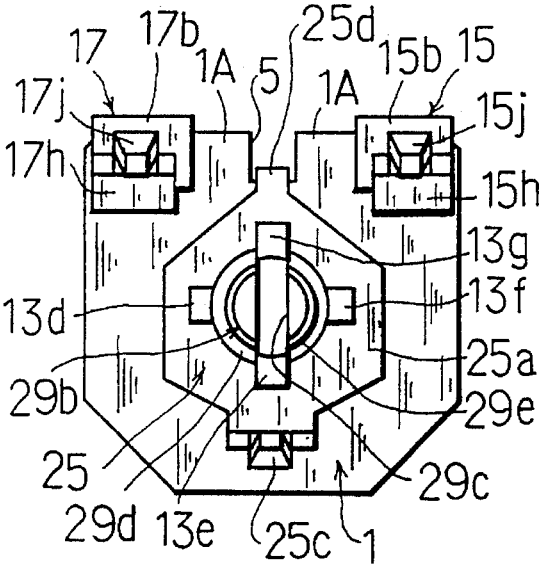
FIG. 1D is a bottom view of the electronic component shown in FIG. 1A.
Figure 2:
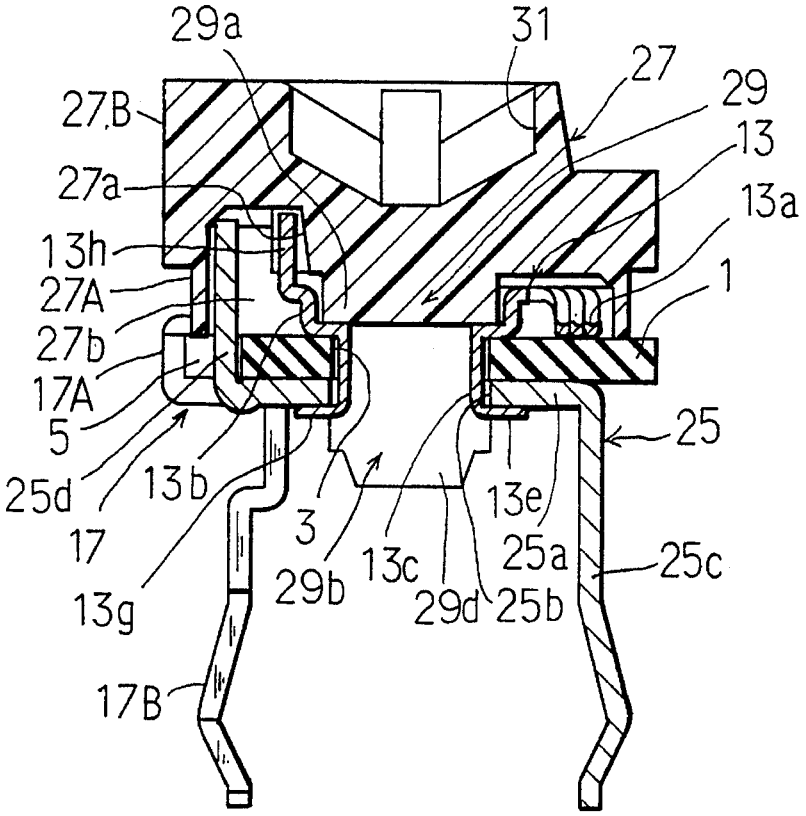
FIG. 2 is a sectional view taken along line II—II of FIG. 1A.

Referring first to FIGS. 1A to 5, an embodiment of an electronic component according to the present invention is illustrated, which is embodied in the form of a variable resistor. In FIGS. 1A to 5, reference numeral 1 designates a substrate made of an insulating material such as ceramic or the like and having front and rear surfaces, which substrate is formed at a central portion thereof with a through-hole 3 as shown in FIG. 2. Also, the substrate 1 is formed on one side end 1A thereof with a recess 5 as shown in FIG. 1D. Further, the substrate 1 is provided on the front surface thereof with a variable resistance element 7 of an arcuate shape in a manner to be concentric with the through-hole 3. The resistance element 7 is provided on both ends thereof with electrodes 9 and 11 made of a silver paint or the like, respectively. The resistance element 7 may be formed by screen-printing a resistance element paint on the substrate 1 and then heating the substrate in an oven. The resistance element paint may comprise a thermosetting resin material containing a carbon powder. The resistance element 7 is provided thereon with a slider 13 including a contact section 13*a*. The slider 13 is so arranged that the contact section 13*a* is slid on a surface of the resistance element 7. Thus, the surface of the resistance element 7 is preferably formed so as to exhibit lubricous properties, to thereby reduce friction between the contact portion 13*a* of the slider 13 and the resistance element 7. Also, when the surface of the resistance element 7 fails to exhibit satisfactory lubricous properties, it is apprehended that an adhesive material used for respectively bonding terminals 13 and 17 described hereinafter to the electrodes 9 and 11 flows on the surface when it adheres to the surface accidentally or by mistake. This tends to occur particularly when an adhesive material which is decreased in thixotropy index is used. Thus, it is desired to employ an approach of rendering at least a portion of a surface of each of both ends of the resistance element 7 adjacent to each of the electrodes 9 and 11 lubrious or smooth to a degree sufficient to prevent the adhesive from flowing thereon. Alternatively, the approach may be eliminated when an adhesive material having an appropriate thixotropy index is selected and application of the adhesive is carried out with high accuracy.

The electrodes 9 and 11 may be formed of a suitable conductive paint such as a silver paint or the like. Alternatively, they may be conveniently formed by plating. The electrodes 9 and 11 each preferably have a coarse surface, because it prevents an adhesive material applied thereto from flowing thereon or oozing out thereof. Formation of the coarse surface may be carried out depending on a manner of formation of the electrodes 9 and 11. For example, when the electrodes are formed of a conductive paint, a conductive powder which is formed into a suitable particulate shape may be added to the conductive paint to provide the surface of each of the electrodes with unevenness or roughness. When the electrodes are formed by plating, dull plating which renders the surface of each of the electrodes dull may be employed for this purpose. The electrodes 9 and 11 of which the surface is thus rendered rough each may be arranged in proximity to each of both ends thereof. This permits an area of a whole printed pattern to be reduced to down size the substrate, to thereby accomplish small-sizing of the variable resistor.

Now, the terminals 15 and 17 mounted on the side end 1A of the substrate 1 will be described hereinafter. The terminal 15 includes a clamp section 15A for interposedly holding the substrate 1 through the upper and lower surfaces thereof and more particularly interposedly holding the side end 1A of the substrate 1 and a leg section 15B formed integrally with the clamp section 15A. The terminal 17 is constructed in substantially the same manner as the terminal 15 and likewise includes a clamp section 17A for interposedly holding the substrate and a leg section 17B formed so as to be integral with the clamp section 17A. In the illustrated embodiment, the terminals 15 and 17 each may be formed by subjecting a plated iron plate to cutting and bending. The plated iron plate may be formed by subjecting an iron plate to copper plating, followed by colder plating. The solder plating is carried out using a solder plating solution which is free of any brightener, so that a dull plated solder layer may be formed on a surface of the terminal, to thereby render the surface rough. The above-described cutting of the terminal causes iron to be exposed on a part of the surface of the terminal, however, an exposure area of the iron can be neglected as compared with a whole surface area of the terminal.

The clamp sections 15A and 17A of the terminals 15 and 17 include first contact element 15*a* and 17*a* contacted with the electrodes 9 and 11, second contact elements 15*b* and 17*b* contacted with the rear surface of the substrate 1, and connection elements 15*c* and 17*c* for connecting the first and second contact elements to each other, respectively. The first contact elements 15*a* and 17*a* are formed into a width smaller than the second contact elements 15*b* and 17*b*, respectively. The width of each of the first contact elements 15*a* and 17*a* is determined in view of a relationship between a size of each of the electrodes 9 and 11 and a contact area thereof required. The width of each of the second contact elements 15*b* and 17*b* is determined depending on strength of bonding required between the contact element and the rear surface of the substrate 1.

Figure 4:
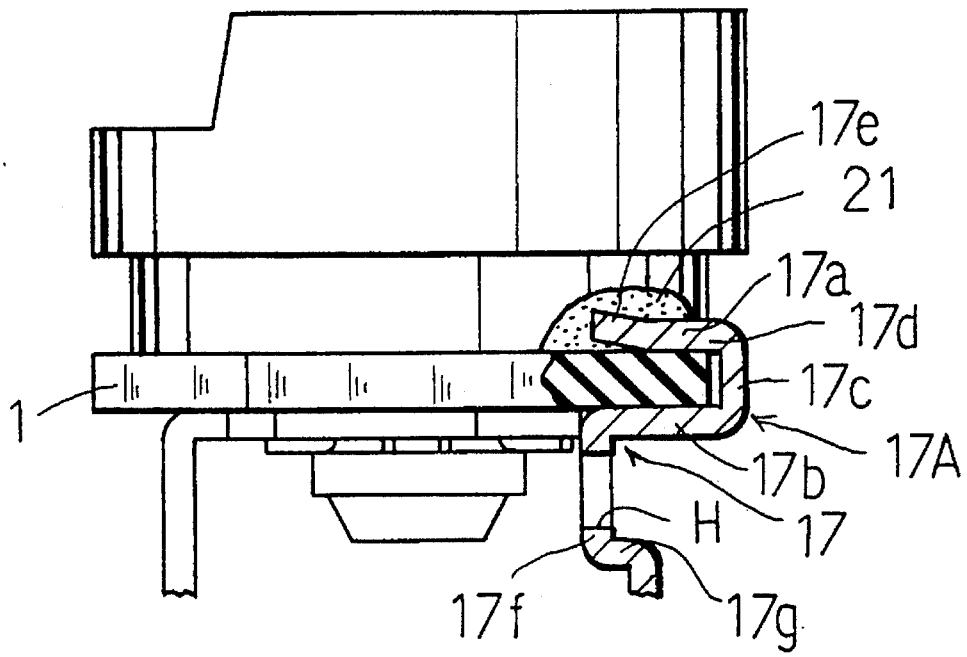
FIG. 4 is a side elevation view partly in section of the electronic component shown in FIG. 1A.
Figure 5:
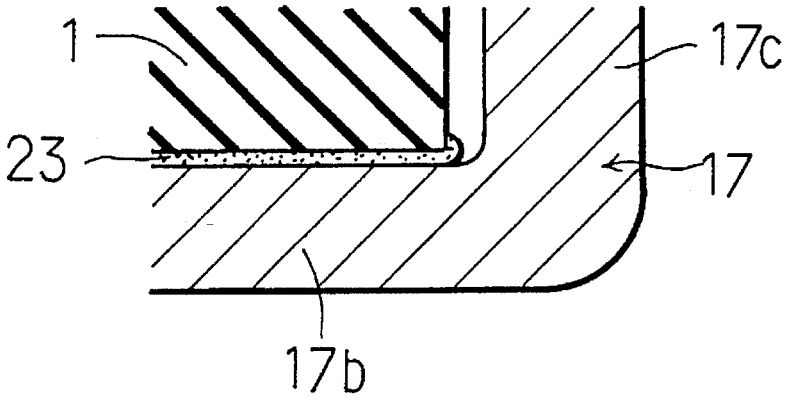
FIG. 5 is a fragmentary enlarged sectional view showing adhesion between a rear surface of a substrate and a clamp section of a terminal.

The first contact elements 15*a* and 17*a* are constructed in the same manner, therefore, the following description will be made on the contact element 17*a* with reference to FIG. 4. The first contact element 17*a*, supposing that it is prior to assembling on the side end 1A of the substrate 1, includes a first inclined portion 17*d* connected at a proximal end thereof to the connection element 17*c* and inclinedly formed so as to gradually approach the second contact element 17*b* with an increase in distance from the connection element 17*c* and a second inclined portion 17*e* connected at a proximal end thereof to a distal end of the first inclined portion 17*d* and inclinedly formed so as to gradually recede from the second contact element 17*b* with an increase in distance from the first inclined portion 17*d*. Supposing that the clamp section 17 is assembled on the side end of the substrate 1, the first contact element 17*a* is expanded so as to recede from the second contact element 17*b*, so that either a connection between the first inclined portion 17*d* and the second inclined portion 17*e* or the first inclined portion 17*d* is contacted with the surface of the electrode 11. Formation of the connection element 17*c* into a reduced length permits the first inclined portion 17*d* to be contacted with the electrode 11, whereas formation of the connection element 17*c* into an increased length permits the connection between the first inclined portion 17*d* and the second inclined portion 17*e* to be contacted therewith. For the purpose of increasing a contact pressure between the first contact element 17*a* and the electrode 11, it is preferable that the connection element 17*c* is formed into a vertical dimension larger than a thickness of the substrate 1 to cause the connection between the first inclined portion 17*d* and the second inclined portion 17*e* to be contacted with the electrode. A decrease in contact pressure exhibits a disadvantage of causing an adhesive material to enter between the first contact element 17*a* and the electrode 11.

The first contact elements 15*a* and 17*a* of the terminals 15 and 17 are provided thereon with adhesion portions 19 and 21, respectively, which may be formed by applying a first adhesive material or thermosetting epoxy adhesive material onto each of the contact elements 15*a* and 17*a*, followed by heating it for curing. In the illustrated embodiment, application of the adhesive is carried out so as to substantially cover a portion of each of the first contact elements 15*a* and 17*a* of the clamp sections 15A and 17A positioned on the electrodes 9 and 11, as well as the electrodes 9 and 11. In the illustrated embodiment, the contact pressure between each of the first contact elements 15*a* and 17*a* and each of the electrodes 9 and 11 is increased as described above, resulting in effectively preventing entrance of the adhesive between the first contact elements and the electrodes, to thereby ensure electrical contact therebetween.

The adhesive applied to the first contact elements 15*a* and 17*a* and electrodes 9 and 11 preferably has a thixotropy index or properties sufficient to substantially prevent the adhesive applied from flowing out of the elements and electrodes. Otherwise, it is required to employ any suitable means such as arrangement of each of the electrodes in a recess. The adhesive which is capable of exhibiting such thixotropy index or properties may be applied by screen printing, leading to mass production of the variable resistor. Such adhesive which is commercially available includes, for example, epoxy adhesive sold under a tradename "PDS 368" by LOCTITE Kabushiki Kaisha. The "PDS 368" adhesive has a thixotropy index of 3.7. In the illustrated embodiment, an adhesive material which has a thixotropy index within a range of from 3 to 4 may be conveniently used to this end.

In the illustrated embodiment, a thermosetting epoxy adhesive material is used for this purpose. Alternatively, any other suitable adhesive materials such as cold-setting adhesive, ultraviolet-curing adhesive and the like may be conveniently used. Also, in the illustrated embodiment, an insulating adhesive material is used as the first adhesive material. Alternatively, a conductive adhesive material may be used as the first adhesive material. To this end, the conductive adhesive may be made by mixing a resin material with a conductive powder ingredient such as a silver powder, a copper powder or the like. In general, a conductive adhesive material which is commercially available tends to be decreased in bond strength as compared with an insulating adhesive material. When the conductive adhesive material used in the illustrated embodiment fails to exhibit satisfactory bond strength, a procedure that the conductive adhesive material is initally applied and cured and then the insulating adhesive material is applied so as to cover the conductive adhesive material, followed by curing may be employed. This results in reinforcing the adhesion portions 19 and 21.

In the illustrated embodiment, application of the first adhesive material is carried out in such a manner that the adhesion portions 19 and 21 substantially cover the first contact elements 15*a* and 17*a*, respectively. The adhesion portions 19 and 21 are provided for the purpose of bonding the first contact elements 15*a* and 17*a* to the electrodes 9 and 11. Therefore, so long as the first adhesive material is applied in a manner to extend between each of the first contact elements 15*a* and 17*a* and each of the electrodes 9 and 11, it is not necessarily required that the adhesion portions 19 and 21 substantially cover the first contact elements 15*a* and 17*b*, respectively.

The second contact elements 15*b* and 17*b* are likewise bonded to the rear surface of the substrate 1 by means of a second adhesive material. In the illustrated embodiment, the bonding is carried out by forming a layer 23 of the second adhesive material between the rear surface of the substrate 1 and each of the second contact elements 15*b* and 17*b*. Seperation of the second contact element 17*b* (15*b*) from the rear surface of the substrate 1 causes a contact pressure between the first contact element 17*a* (15*a*) and the electrode 11 (9) to be reduced, leading to a failure in electrical contact therebetween. In view of the problem, the adhesive layer 23 is arranged between the second contact element 17*b* (15*b*) and the substrate 1 to adhesively join both to each other, to thereby prevent a decrease in contact pressure therebetween. It is inherently impossible to form a gap of a sufficient size between the second contact element 17*b* (15*b*) and the substrate 1 for arranging the adhesive layer 23 therein, so that the second adhesive material used for the adhesive layer 23 preferably has reduced thixotropy properties or a small thixotropy index. More particularly, the second adhesive material preferably has a thixotropy index sufficient to permit the adhesive to be spread in the gap by a capillary action. Adhesive which is commercially available for the second adhesive material includes, for example, thermosetting epoxy adhesive sold under a tradename "KA 215" by Toyo Doseki Kabushiki Kaisha. The commercially available "KA 215" adhesive has a thixotropy index of 1. The second adhesive material is previously applied to the rear surface of the substrate 1 and/or the second contact element 17*b* (15*b*) for forming the adhesive layer 23.

Alternatively, bonding of the second contact element 17*b* (15*b*) to the rear surface of the substrate 1 may be carried out by applying the second adhesive material in a manner to substantially cover the second contact element 17*b* (15*b*) as in the bonding of the first contact element 17*a* (15*a*) to the electrode 11 (9) described above. Thus, in this instance, adhesive of an increased thixotropy index or increased thixotropy properties may be used as the second adhesive material, as in formation of the adhesion portions 19 and 21 described above.

Now, the leg sections 15B and 17B of the terminals 15 and 17 will be described hereinafter. The leg section 15B of the terminal 15 and the leg section 17B of the leg 17 may be constructed in substantially the same manner, therefore, the same alphabete are used to designate corresponding components or parts of both leg sections 17B and 15B. Thus, the following description will be made on the leg section 17B of the terminal 17.

The leg section 17B of the terminal 17, as shown in FIG. 1B, includes a first portion 17*f* formed so as to be contiguous to the second contact element 17b of the clamp section 17A and extend away from the rear surface of the substrate 1, a second portion 17g formed so as to be contiguous to the first portion 17f and extend in the same direction as the second contact element 17b of the clamp section 17A, and a third portion 17h formed so as to be contiguous to the second portion 17g and extend in the same direction as the first portion 17f.

The first portion 17f is formed with a through-hole H so as to laterally extend therethrough. The through-hole H acts to permit the first portion 17f to be deformed to prevent the second contact element 17b of the clamp section 17A from being separated from the substrate 1 when any external force sufficient to bend the leg section 17B is applied thereto. Thus, in the illustrated embodiment, the first portion 17f constitutes an external force absorber. The second portion 17g is adapted to be contacted with a surface of a circuit board when it is inserted into a through-hole of the circuit board, resulting in functioning as a stopper. Also, a corner defined between the second portion 17g and the first portion 17f and that defined between the second portion 17g and the third portion 17h, before the leg section 17B is inserted into the through-hole of the circuit board, each are adapted to be deformed, to thereby act as an external force absorber, when any external force is applied to the leg section 17B. The third portion 17h includes a straight portion 17i and a bent portion 17j. The bent portion 17j, when the leg section 17B is inserted into the through-hole of the circuit board, acts as a means for preventing it from being drawn out of the through-hole.

Figure 3:
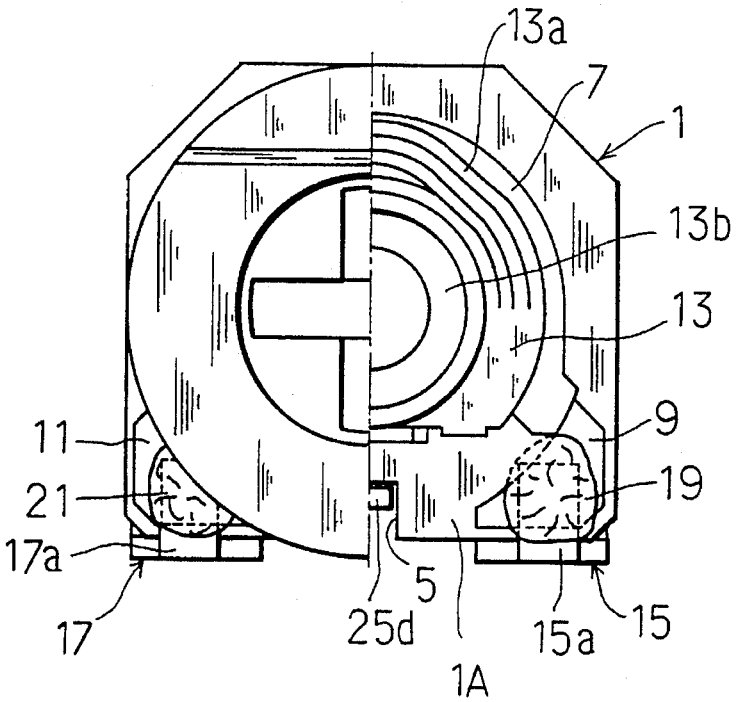
FIG. 3 is a partially cutaway plan view of the electronic component shown in FIG. 1A.

The slider 13, as shown in FIGS. 1D, 2 and 3, is formed of a metal sheet by working and includes, in addition to the above-described contact section 13a, a receiving section 13b on which the contact section 13a is integrally mounted, a tubular section 13c integrally provided on the receiving section 13a, four projections 13d to 13g provided on an end of the tubular section 13c in a manner to be circumferentially spaced from each other at predetermined intervals, and a stopper section 13h integrally provided on the receiving section 13b. The tubular section 13c of the slider 13 is rotatably fitted in the through-hole 3 of the substrate 1 and a through-hole 25b formed via a horizontal section 25a of an intermediate terminal 25 mounted on the rear surface of the substrate 1. The four projections 13d to 13g provided on the end of the tubular section 13c each are bent toward or along the horizontal section 25a of the intermediate terminal 25 to prevent dislocation of the slider 13. The stopper section 13h is fitted in a recess 27a formed in a cap or rotator 27 made of an insulating resin material, to thereby prevent rotation of the slider 3.

The intermediate terminal 25 also includes a leg section 25c and a raised section 25d acting as a stopper. The raised section 25d is fitted in the recess 5 of the substrate 1 and formed so as to extend at a distal end thereof into a space 27b defined in the rotator 27. In the internal space 27b of the rotator 27 is received a main part of the slider 13, and the raised section 25d of the intermediate terminal 25 is abutted against a wall of the rotator 27 defining the internal space 27b to prevent rotation of the rotator 27.

The rotator 27 includes a slide section 27A adapted to be slid on the front surface of the substrate 1 and an operation section 27B integrally mounted on the slide section 27A. The slide section 27A is formed into an outer diameter which prevents an outer peripheral surface thereof from being contacted with the adhesion sections 19 and 21, as well as into a height larger than that of each of the adhesion sections 19 and 21. Also, a maximum outer diameter of the operation section 27B is formed so as to be larger than an outer configuration of the slide section 27A. Formation of the rotator 27 into such dimensions permits the rotator 27 to be smoothly rotated irrespective of the adhesion sections 19 and 21 and permits the operation section 27B to be large-sized to a degree sufficient to facilitate operation of the section 27B.

The operation section 27B of the rotator 27 is mounted on a central portion thereof with a revolving shaft 29. The revolving shaft 29 includes a first fit-on section 29a fitted in the receiving section 13b of the slider 13 and a second fit-on section 29b fitted in the tubular section 13c of the slider 13. The second fit-on section 29b is formed at a central portion thereof with a depression 29c in a manner to extend in an axial direction thereof, so that two split portions 29d and 29c are defined by the depression 29c. Then, the split portions 29d and 29e thus formed each are subject at a distal end thereof to deformation by heating, to thereby provide a stopper. The operation section 27B of the rotator 27 is formed with a depression 31 acting as a driver receiver, in which a driver for adjustment is inserted. The depression 29c described above likewise acts as a driver receiver.

Figure 6:
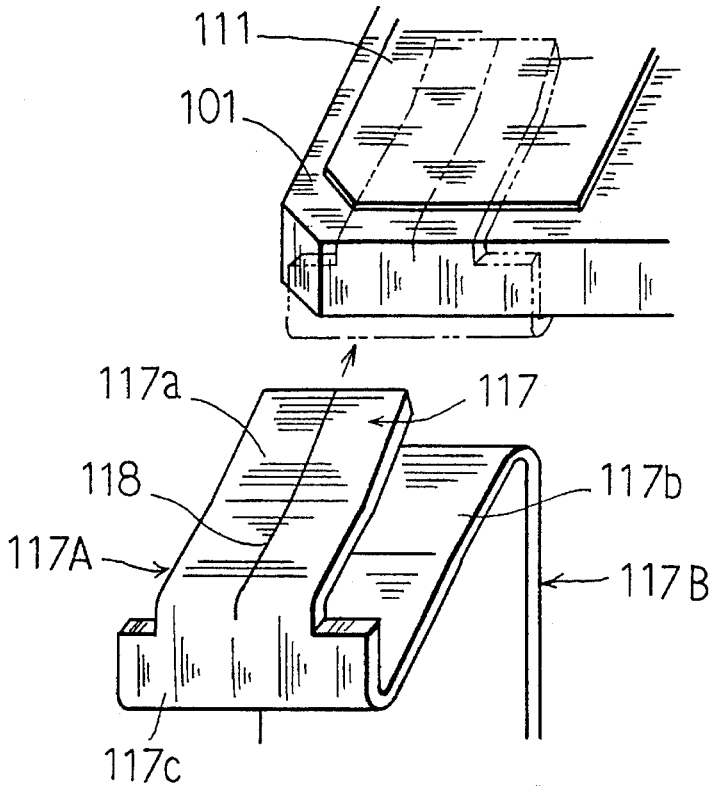
FIG. 6 is a perspective view showing a modification of a terminal which may be incorporated in an electronic component of the present invention.

Now, a modification of the terminal described above will be described hereinafter with reference to FIG. 6, wherein parts of the modification corresponding to those of the terminal described above are designated at reference characters represented by adding numeral "100" to the reference characters used for indicating the parts of the above-described terminal. The terminal shown in FIG. 6 includes a clamp section 117A including a first contact element 117a, which is formed with a slit-like depression or groove 118, so that the first contact element 117a divided into two split portions by the depression 118. A second contact element 117b is bent at a central portion thereof toward the first contact element 117a. The construction of the terminal 117 wherein the first contact element is divided into two such split portions ensures positive electrical contact between the first contact element 117a and an electrode 111. On the contrary, formation of the first contact element 117a into a single-peace construction exhibits a disadvantage of causing dust or the like to enter between the first contact element 117a and the electrode 111, to thereby deteriorate electrical connection therebetween. The construction of the illustrated embodiment wherein the first contact element is formed of a plurality of such split portions permits contact between at least one of the split portions and the electrode 111 to ensure satisfactory electrical connection between the first contact element 117a and the electrode 111. The terminal of the modification is formed with the single depression 118, resulting in being divided into two such split portions. Alternatively, it may be formed with two or more depressions, to thereby be divided into three or more split portions. The first contact element 117a of the terminal 117 and its second contact element 117b are bonded to the substrate by means of an adhesive material as in the terminal described above.

Figure 7A:
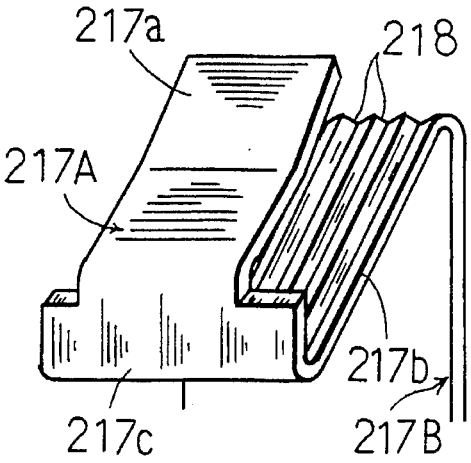
FIG. 7A is a perspective view showing a clamp section of another modification of a terminal which may be incorporated in an electronic component of the present invention.
Figure 7B:
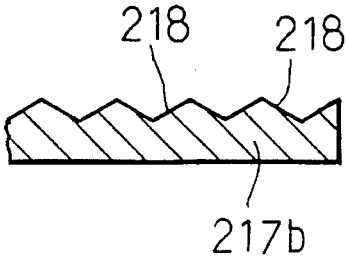
FIG. 7B is a sectional view showing an essential part of the clamp section of FIG. 7A.

Another modification of the terminal is illustrated in FIGS. 7A and 7B, wherein parts of the modification corresponding to those of the terminal described above with reference to FIGS. 1A to 5 are designated at reference characters represented by adding numeral "200" to the reference characters used for indicating the parts of the above-described terminal. A terminal of the modification includes a second contact element 217b, which is formed on a surface thereof contacted with the rear surface of the substrate with a plurality of grooves 218 by pressing. The grooves 218 each are formed into a depth which permits an adhesive material to be spread through the groove by a capillary action. Formation of such grooves facilitates and promotes formation of an adhesive layer between the second contact element 217*b* and the rear surface of the substrate. The terminal of the modification also includes a first contact element 217*a*, which is bonded to the substrate together with the second contact element 217*b* by means of an adhesive material.

Figure 8A:
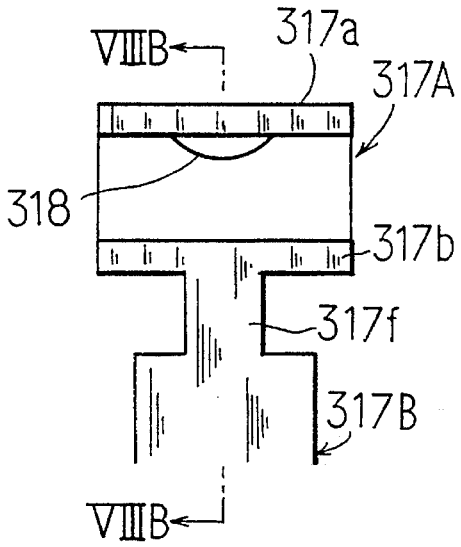
FIG. 8A is a front elevation showing a clamp section of a further modification of a terminal which may be incorporated in an electronic component of the present invention.
Figure 8B:
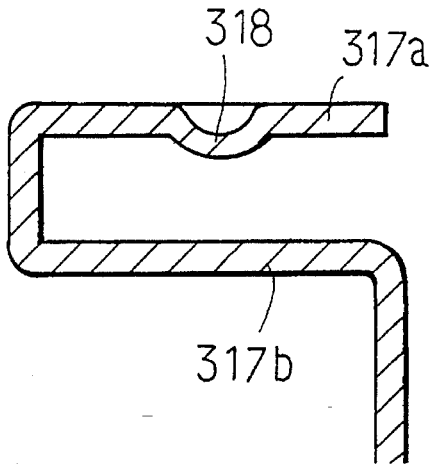
FIG. 8B is a sectional view taken along line VIIIB—VIIIB of FIG. 8A.

A further modification of the terminal is illustrated in FIGS. 8A and 8B, wherein parts of the modification corresponding to those of the terminal described above with reference to FIGS. 1A to 5 are designated at reference characters represented by adding numeral "300" to the reference characters used for indicating the parts of the above-described terminal. A terminal of the further modification includes a first contact element 317*a* and a second contact element 317*b*, wherein the first contact element 317*a* is formed with a projection 318 so as to extend toward the second contact element 317*b* by pressing. Such arrangement of the projection 318 causes a pressure to be concentrated at a distal end of the projection 318, leading to an increase in contact pressure between the first contact element 317*a* and the electrode. In the modification, at least one such projection 318 may be provided. Also, the terminal 317 of the modification includes a leg section 317B including a first portion 317*f*, which is formed into a thin shape without being provided with a through-hole, to thereby act as an external force absorber which absorbs any external force applied thereto. The first and second contact elements 317*a* and 317*b* of the terminal 317 of the modification are likewise bonded to the substrate by means of an adhesive material.

Figure 9:
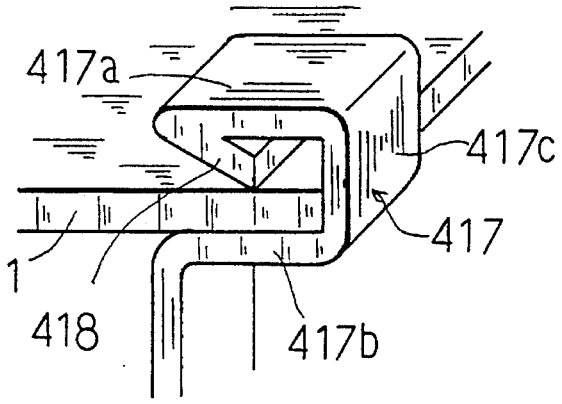
FIG. 9 is a perspective view showing a relationship between the clamp section shown in FIG. 8A and a substrate.

Still another modification of the terminal is illustrated in FIG. 9, wherein parts of the modification corresponding to those of the terminal described above with reference to FIGS. 1A to 5 are designated at reference characters represented by adding numeral "400" to the reference characters used for indicating the parts of the above-described terminal. A terminal 417 of the illustrated modification includes a first contact element 417*a* , which is bent at a distal end thereof toward a second contact element 417*b*, to thereby provide a bent portion 418 which is contacted at a distal end thereof with a front surface of the substrate 1. The second and third contact elements 417*a* and 417*b* are bonded to the substrate 1 by means of an adhesive material.

Figure 10:
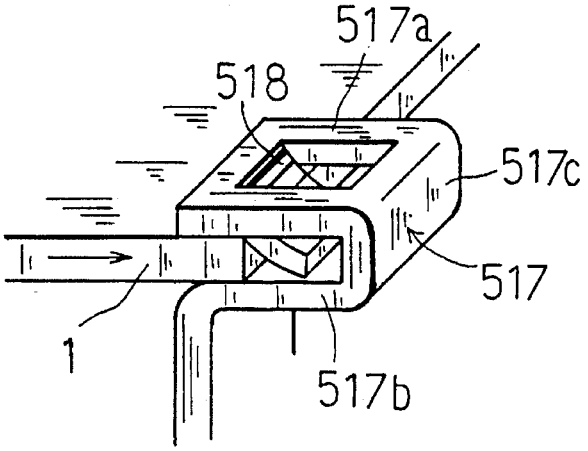
FIG. 10 is a perspective view showing a relationship between a substrate and a clamp section of still another modification of a terminal which may be incorporated in an electronic component of the present invention.

Yet another modification of the terminal is illustrated in FIG. 10, in which parts of the modification corresponding to those of the terminal described above with reference to FIGS. 1A to 5 are designated at reference characters represented by adding numeral "500" to the reference characters used for indicating the parts of the above described terminal. In a terminal 517 of the illustrated modification, a first contact element 517*a* is raised toward a second contact element 517*b*, to thereby provide a raised portion 518, which is contacted with the electrode (not shown) arranged on the front surface of a substrate 1. The first and second contact elements 517*a* and 517*b* of the terminal 517 are likewise adhesively bonded to the substrate.

Figure 11A:
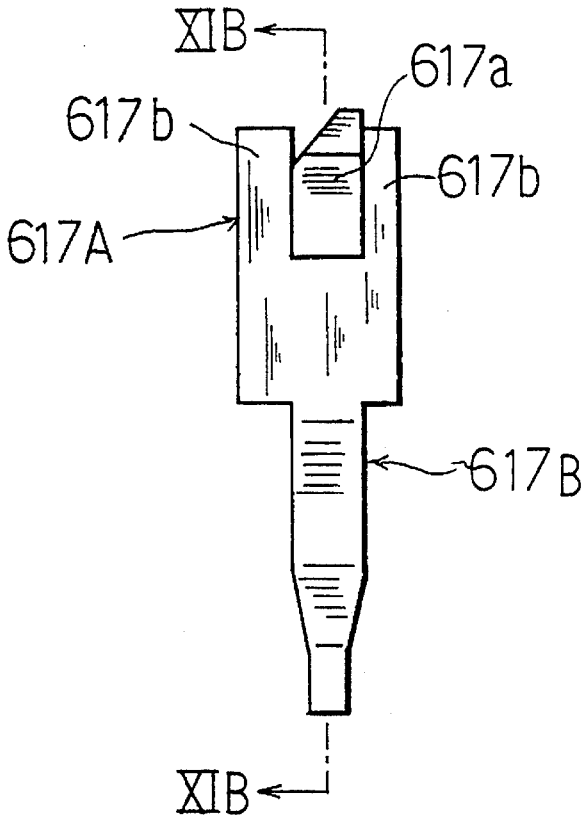
FIG. 11A is a front elevation view showing a still further modification of a terminal which may be incorporated in an electronic component of the present invention.
Figure 11B:
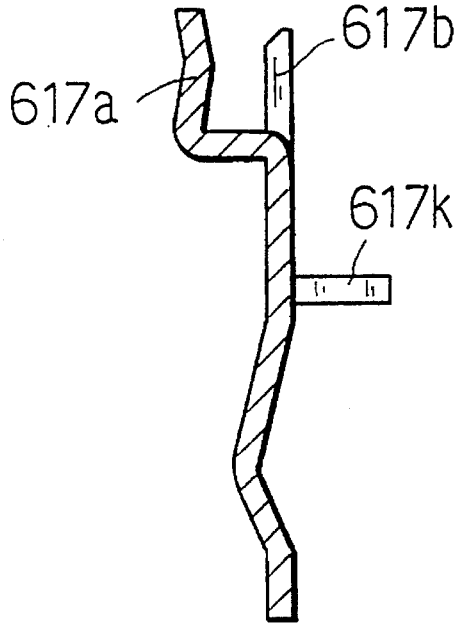
FIG. 11B is a sectional view showing XIB—XIB of FIG. 11A.
Figure 11C:
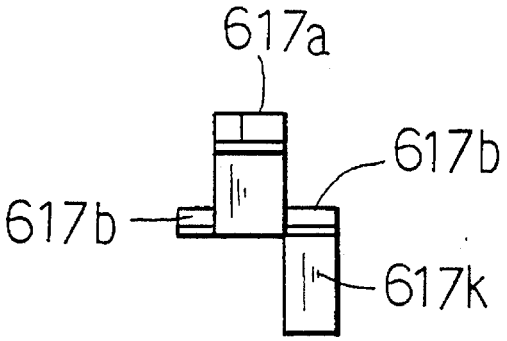
FIG. 11C is a plan view of the terminal shown in FIG. 11A.

A still further modification of the terminal is illustrate in FIGS. 11A to 11C, wherein parts of the modification corresponding to those of the terminal described above with reference to FIGS. 1A to 5 are designated at reference characters represented by adding numeral "600" to the reference characters used for indicating the parts of the above-described terminal. The terminals described above with reference to FIGS. 1A to 10 each are adapted to orientate the substrate in parallel to the circuit board. A terminal 617 of the illustrated modification is featured in that a clamp section 617A is constructed of a first contact element 617*a* and two second contact elements 617*b*. Reference character 617*c* designates a stopper adapted to be contacted with the front surface of the circuit board (not shown) described above. The first and second contact elements 617*a* and 617*b* are likewise adhesively bonded to the substrate.

In each of the embodiments described above, the second contact element of the clamp section of the terminal is adhesively bonded to the rear surface of the substrate. Alternatively, when the variable resistor may be constructed so as to be handled while preventing undue force from being applied to the terminal, only the first contact element may be adhesively fixed to the electrode on the substrate.

Further, the substrate may be formed on at least one surface thereof with a recess, in which the first and second contact elements of the clamp section may be fitted.

Although the above description has been made on application of the present invention to the variable resistor, the present invention may be conveniently applied to any other electronic component such as a switch, a capacitor, a integrated circuit or the like.

The terminals in various forms described above each include the leg section constructed integrally with the clamp section. However, the connection section provided integrally with the clamp section may be constructed into any suitable configuration. It may be formed into a configuration other than that of the leg section.

As can be seen from the foregoing, the electronic component of the present invention is so constructed that at least the first contact element of the clamp section of the terminal is adhesively bonded to the electrode arranged on the substrate. Such construction eliminates soldering and therefore a washing procedure using freon. Also, elimination of soldering permits heating of the electronic component during the soldering to be eliminated, to thereby prevent heat deterioration thereof.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An electrical component comprising:

an insulating substrate having front and rear surfaces;

an electronic element arranged on said front surface of said insulating substrate;

electrodes arranged on said front surface of said insulating substrate and electrically connected to said electronic element; and a terminal made of a metal material and contacted with one of said electrodes;

said terminal including a clamp section for clamping said substrate through said front and rear surfaces of said substrate;

said clamp section including a first contact element contacted with said one electrode and a second contact element contacted with said rear surface of said substrate;

said first contact element of said clamp section being bonded to said one electrode by means of a first adhesive material and said second contact element being bonded to said rear surface of said substrate by means of a second adhesive material.

2. An electrical component as defined in claim 1, wherein said first adhesive material is applied so as to cover a portion of said member of said clamp section positioned on said one electrode.

3. An electronic component as defined in claim 1, wherein said first adhesive material is applied so as to extend between said one electrode and said member of said clamp section.

4. An electrical component as defined in claim 1, wherein said second adhesive material forms a layer between said second contact element and said rear surface of said substrate.

5. An electrical component as defined in claim 1, wherein said first adhesive material is conductive.

6. An electrical component as defined in claim 1, wherein said first adhesive material has a thixotropy index sufficient to substantially prevent said first adhesive material from flowing out of a region to which it is applied.

7. An electrical component as defined in claim 1, wherein said first contact element of said clamp section is divided into a plurality of portions.

8. An electrical component as defined in claim 1, wherein said first contact element of said clamp section is bent at a distal end thereof so as to project toward said second contact element.

9. An electrical component as defined in claim 1, wherein said first contact element of said clamp section is formed with at least one projection in a manner to project toward said second contact element by pressing.

10. An electrical component as defined in claim 1, wherein said second contact element of said clamp section is formed on a surface thereof contacted with said rear surface of said substrate with a plurality of grooves.

11. An electrical component as defined in claim 1, wherein said first contact element of said clamp section is bent toward said second contact element.

12. An electrical component as defined in claim 1, wherein said first contact element of said clamp section is formed with a raised portion which is raised toward said second contact element.

13. An electrical component as defined in claim 4, wherein each of surfaces of said first and second contact elements contacted with said adhesive materials is formed so as to be coarse.

14. An electrical component as defined in claim 13, wherein at least said clamp section of said terminal is subject to dull plating.

15. An electrical component as defined in claim 4, wherein said second adhesive material has a thixotropy index which permits said second adhesive material to be spread between said second contact element and said rear surface of said substrate due to a capillary action.

16. An electrical component as defined in claim 1 or 4, wherein said terminal includes a leg section formed integrally with said clamp section;

said leg section being provided with an external force absorber;

said external force absorber being deformed to prevent said second contact element of said clamp section from being separated from said rear surface of said substrate when external force is applied to said leg section.

17. An electrical component as defined in claim 16, wherein said external force absorber comprises a portion of said leg section which is formed with a laterally extending through-hole.

18. An electrical component as defined in claim 17, wherein said leg section of said terminal includes a first portion formed so as to be contiguous to said second contact element of said clamp section and extend in a direction away from said rear surface of said substrate, a second portion formed so as to be contiguous to said first portion of said clamp section and extend in a direction in which said second contact element extends, and a third portion formed so as to be contiguous to said second portion and extend in the direction in which said first portion extends:

said through hole of said leg section being formed through said first portion.

19. An electrical component comprising:

an insulating substrate having a front surface and a rear surface;

a variable resistance element arranged on said front surface of said insulating substrate;

two electrodes arranged on said front surface of said substrate and each connected to each of both ends of said variable resistance element;

a slider arranged so as to be slid on said variable resistance element;

a rotator which is rotatably supported on said substrate and on which said slider is fixed;

an intermediate terminal made of a metal material and fixed on said substrate;

said intermediate contact including a contact section contacted with said slider; and two terminals made of a metal material and contacted with said two electrodes, respectively;

said terminals each including a clamp section for clamping said substrate through said front and rear surfaces of said substrate and a leg section provided integrally with said clamp section;

said clamp sections of said terminals each including a first contact element contacted with each of said electrodes and a second contact element contacted with said rear surface of said substrate;

said first contact element of each of said clamp sections and each of said electrodes each having a first adhesive material applied thereto to carry out bonding between said first contact element and said electrode;

said second contact elements each being bonded to said rear surface of said substrate by means of a second adhesive material.

20. An electrical component as defined in claim 19, wherein said rotator includes a slide section slid on said front surface of said substrate and an operation section formed integrally with said slide section;

said slide section being formed into an outer diameter which prevents an outer periphery of said slide section from being contacted with said first adhesive material cured and a height larger than that of said first adhesive material cured;

said operation section having a maximum outer diameter larger than an outer dimension of said slide section.

* * * * *

UNITED STATES PATENT AND TRADEMARK OFFICE

CERTIFICATE OF CORRECTION

PATENT NO. : 5,525,956
DATED : June 11, 1996
INVENTOR(S) : Hashizume et al.

It is certified that error appears in the above-indentified patent and that said Letters Patent is hereby corrected as shown below:

Column 3, line 57, delete "lubrious" and insert --lubricous--.

Column 6, line 62, delete "alphabete" and insert --alphabets--.

Column 11, line 5, delete "electronic" and insert --electrical--.

Signed and Sealed this

Fifteenth Day of October, 1996

Bruce Lehman

*Attest:*

BRUCE LEHMAN

*Attesting Officer*

*Commissioner of Patents and Trademarks*